US011158253B1

(12) United States Patent
Hwang et al.

(10) Patent No.: US 11,158,253 B1
(45) Date of Patent: Oct. 26, 2021

(54) SYSTEMS AND METHODS FOR SENSING PIXEL VOLTAGES

(71) Applicant: Apple Inc., Cupertino, CA (US)

(72) Inventors: Injae Hwang, Cupertino, CA (US); Hung Sheng Lin, San Jose, CA (US); Hyunwoo Nho, Palo Alto, CA (US); Sun-Il Chang, San Jose, CA (US); Rui Zhang, Sunnyvale, CA (US); Mohammad B. Vahid Far, San Jose, CA (US); Kingsuk Brahma, Mountain View, CA (US); Jesse A. Richmond, San Francisco, CA (US); Hyunsoo Kim, Mountain View, CA (US); Junhua Tan, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 34 days.

(21) Appl. No.: 16/563,500

(22) Filed: Sep. 6, 2019

Related U.S. Application Data

(60) Provisional application No. 62/728,665, filed on Sep. 7, 2018.

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0852* (2013.01); *G09G 2300/0861* (2013.01); *G09G 2310/027* (2013.01)

(58) Field of Classification Search
CPC ..... G09G 3/3233–3291
See application file for complete search history.

(56) References Cited

U.S. PATENT DOCUMENTS

| | | | | |
|---|---|---|---|---|
| 9,355,596 | B2 | 5/2016 | Shin et al. | |
| 9,959,807 | B2 | 5/2018 | Lee | |
| 2008/0048951 | A1 | 2/2008 | Naugler, Jr. et al. | |
| 2014/0375533 | A1* | 12/2014 | Kim | G09G 3/3233 345/78 |
| 2019/0088205 | A1 | 3/2019 | Zhang et al. | |
| 2019/0156718 | A1 | 5/2019 | Moradi et al. | |
| 2019/0259341 | A1 | 8/2019 | Park et al. | |

* cited by examiner

*Primary Examiner* — Hang Lin
(74) *Attorney, Agent, or Firm* — Fletcher Yoder, P.C.

(57) ABSTRACT

A display device may include a plurality of pixels configured to display image data on a display. The display device may also include a circuit that measures a first current associated with a light-emitting diode (LED) of a pixel of the plurality of pixels in response to the circuit receiving a first data voltage. The circuit may also measure a second current associated with the LED of the pixel of the plurality of pixels in response to the circuit receiving a second data voltage. The circuit may then determine a voltage associated with the LED based at least in part on the first current and the second current.

20 Claims, 8 Drawing Sheets

$I_{TFT}=K(V_{DATA1}-V_{REF}-V_{TH})^2$

SYSTEMS AND METHODS FOR SENSING PIXEL VOLTAGES

CROSS-REFERENCE TO RELATED APPLICATIONS

This application claims the benefit of U.S. Provisional Application No. 62/728,665, entitled "Systems and Methods for Sensing Pixel Voltages," filed on Sep. 7, 2018, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light-emitting diodes such as organic light-emitting diodes (OLEDs) or active matrix organic light-emitting diodes (AMOLEDs) may be employed as pixels to depict a range of gray levels for display. However, due to various properties associated with the operation of these pixels within the display device, a particular gray level output by one pixel in a display device may be different from a gray level output by another pixel in the same display device upon receiving the same electrical input. More specifically, aging of circuit components, such as the OLED used to emit light, may cause the electrical properties associated with the corresponding pixel current to change, thereby producing inconsistent or non-uniform colors across the display device.

With this in mind, the electrical inputs used to represent image data may be calibrated to account for the aging effects of the OLED by sensing the electrical values that get stored into the corresponding pixel circuit and adjusting the input electrical values accordingly. Since the aging effects of the OLED or other pixel circuit component changes over time, the present disclosure details various systems and methods that may be employed to implement a sensing scheme to sense variations in pixel properties (e.g., current, voltage) and modify a data voltage applied to a respective pixel based at least in part on the sensed variation. The corrected data voltage, when applied to the respective pixel, may compensate for the variations in the pixel properties that may be due to the aging of the pixel circuit component (e.g., LED) to achieve a more uniform image that will be depicted on the display device.

In certain embodiments, a sensing system of a display device may use a sensing circuit and a pixel driving circuit to determine or measure a voltage ($V_{OLED}$) associated with a light-emitting diode (LED) of the pixel. The voltage ($V_{OLED}$) associated with the LED in a pixel may change over time due to aging of the LED. As such, an accurate measurement of the voltage ($V_{OLED}$) associated with the LED while the LED receives some current may be useful in compensating image data received by a display, such that the compensated image data may cause a respective LED to more accurately present a desired luminance or gray level, as specified in the originally received image data. Moreover, as different LEDs age over time, the sensing system may use the voltage ($V_{OLED}$) at the LED to compensate image data provided to each pixel of the display, thereby enabling the display to present image data more uniformly across various pixels in the display.

With the foregoing in mind, the present embodiments described herein may include a sensing system of a display device that may control the operations of a pixel circuit. In some embodiments, the pixel circuit may receive a first data voltage ($V_{DATA1}$) from the sensing system. After sending the first data voltage first data voltage ($V_{DATA1}$) to the pixel circuit, the sensing system may control various switches in the pixel circuit to cause a drive thin-film transistor (TFT) to receive a current ($I_{TFT}$). The drive TFT current ($I_{TFT}$) may then be routed to a sensing circuit (e.g., active-front-end circuit), instead of a light-emitting diode of the pixel circuit. The sensing circuit may detect or measure the amount of current ($I_{TFT}$) conducted through the drive TFT switch.

The sensing system may then program the LED with a second data voltage by causing the drive TFT to send current to LED. After programming the LED, the sensing system may direct the current from the LED to the sensing circuit to determine the amount of current conducted through the LED (LEO. After determining the LED current (LEO, the sensing system may adjust the second data voltage until the LED current (LEO is substantially equal (e.g., within 1-10%) to the drive TFT current ($I_{TFT}$). Based at least in part on known variables including the first data voltage, the second data voltage, the threshold voltage of the LED, the sensing system may determine the voltage at the LED (WED). This LED voltage (WED) may provide an indication of how the LED of the pixel circuit is aging. That is, the LED current (LEO received by the LED should correspond to an expected voltage level for the LED. As the LED ages, the voltage level at the LED degrades or decreases when the same LED current (LEO is provided to the LED.

In some embodiments, the voltage at the LED (VLED) may be sensed by transmitting test image data to the respective pixel circuit. However, this method may cause visual artifacts and a user may notice that the display device is changing its display. To make the sensing of LED voltages (VLED) less noticeable, the present embodiments employ the drive TFT to assist in determining the LED voltage (VLED). That is, the current through the drive TFT may be sensed without sending current to the LED and compared with a current read out from the pixel circuit after programming the respective LED.

After determining the LED voltage (VLED), the sensing system or other suitable component may then use the LED voltage (VLED) to determine a compensation factor to apply to pixel data provided to a respective pixel. In other words, image data received by the sensing system that includes pixel data representative of a grey level to be presented by a respective LED may be adjusted based at least in part on the change in voltage, as indicated based at least in part on the sensed LED voltage (VLED) and the corresponding LED current (LEO. The adjusted image data may then be transmitted to the respective pixel circuit to cause the respective LED to present light according to the adjusted image data. By employing the sensing system described herein for one or more pixels in a display device, the display device may present image data more uniformly across the display as the LEDs of the device ages.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
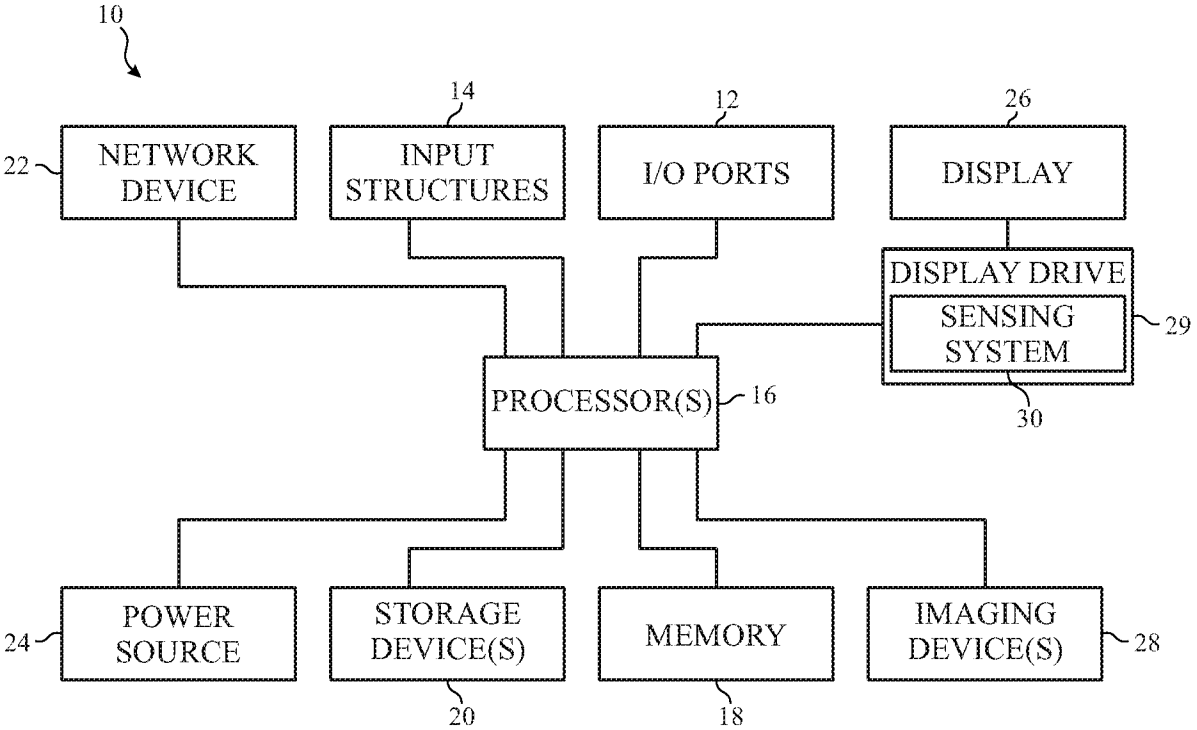
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based at least in part on" B is intended to mean that A is at least partially based at least in part on B. Moreover, the term "or" is intended to be inclusive (e.g., logical OR) and not exclusive (e.g., logical XOR). In other words, the phrase A "or" B is intended to mean A, B, or both A and B.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given variations in manufacturing, various noise sources present within a display device, aging of circuit components in the display device, or various ambient conditions in which each display device operates, different pixels within a display device might emit a different color value or gray level even when provided with the same electrical input. It is desirable, however, for the pixels to uniformly depict the same color or gray level when the pixels programmed to do so to avoid visual display artifacts due to inconsistent color.

Organic light-emitting diode (e.g., OLED, AMOLED) display panels provide opportunities to make thin, flexible, high-contrast, and color-rich electronic displays. Generally, OLED display devices are current driven devices and use thin film transistors (TFTs) as current sources to provide certain amount of current to generate a certain level of luminance to a respective pixel electrode. OLED Luminance to current ratio is generally represented as OLED efficiency with units: cd/A (Luminance/Current Density or $(cd/m^2)/(A/m^2)$). Each respective TFT, which provides current to a respective pixel, may be controlled by gate to source voltage ($V_{gs}$), which is stored on a capacitor ($C_{st}$) electrically coupled to the LED of the pixel.

Generally, the application of the gate-to-source voltage $V_{gs}$ on the capacitor $C_{st}$ is performed by programming voltage on a corresponding data line to be provided to a respective pixel. However, as the OLED ages, the OLED may respond differently to the current provided to it. As a result, different OLEDs receiving the same amount of current may react differently, thereby providing non-uniformity in luminance or color across the display.

With the foregoing in mind, the present disclosure describes a system and method for sensing a voltage of the OLED for a particular current conducted through the OLED. The sensed voltage level may then be used for compensating pixel data provided to a respective pixel circuit to cause the respective OLED to react or depict light (e.g., grey level) more uniformly across the display. Additional details with regard to the manner in which a sensing system may be used to detect a voltage at the LED of a pixel circuit are detailed below with reference to FIGS. 1-9.

By way of introduction, FIG. 1 is a block diagram illustrating an example of an electronic device 10 that may include the sensing system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, network device 22, power source 24, display 26 with a display driver 29, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

The electronic device 10 may include a display driver 29, which may include a chip, such as processor or ASIC, that may control various aspects of the display 26. It should be noted that the display driver 29 may be implemented in the CPU, the GPU, image signal processing pipeline, display pipeline, driving silicon, or any suitable processing device that is capable of processing image data in the digital domain before the image data is provided to the pixel circuitry.

In certain embodiments, the display driver 29 may include a sensing system 30, which may detect a voltage ($V_{OLED}$) at an anode side of an LED while the LED receives a particular current value (LED). In some embodiments, the sensing system 30 and/or the display driver 29 may adjust image data provided to the display 26 based at least in part on a difference between an expected voltage at the LED and the sensed voltage at the LED to compensate for aging effects of the LED over time. As will be described in more detail below, the sensing system 30 may sense the voltage levels of one or more OLEDs of the display 26 over time to compensate for aging effects of the respective OLEDs. As a result, the image data presented by the display 26 may be depicted more uniformly across the display 26.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs).

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a sensing system 30, which may include a chip, such as processor or ASIC, that may control various aspects of the display 26. It should be noted that the sensing system 30 may be implemented in the CPU, the GPU, or any suitable processing device that processes image data in the digital domain before the image data is provided to the pixel circuitry.

Figure 2:
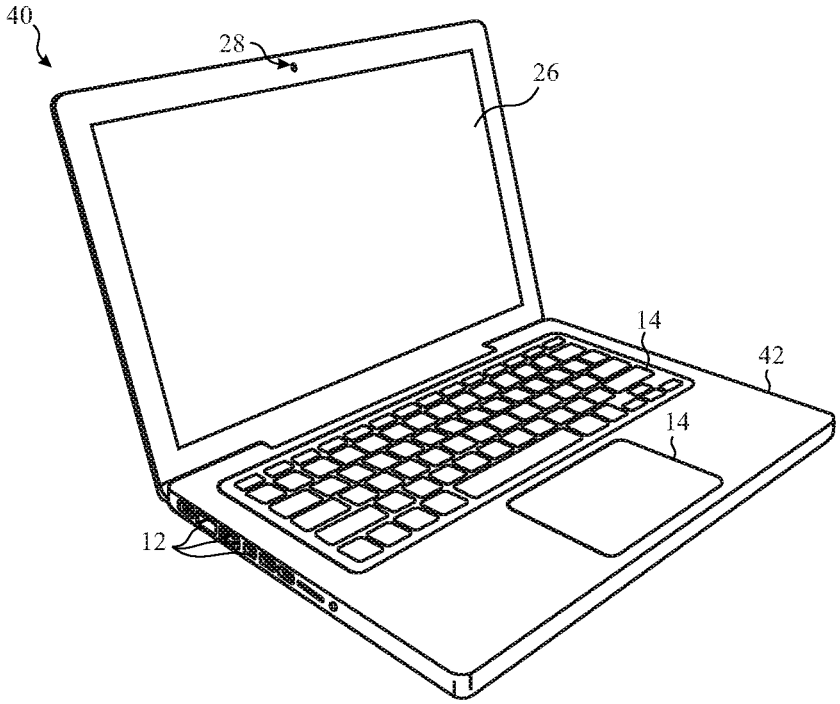
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 22), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
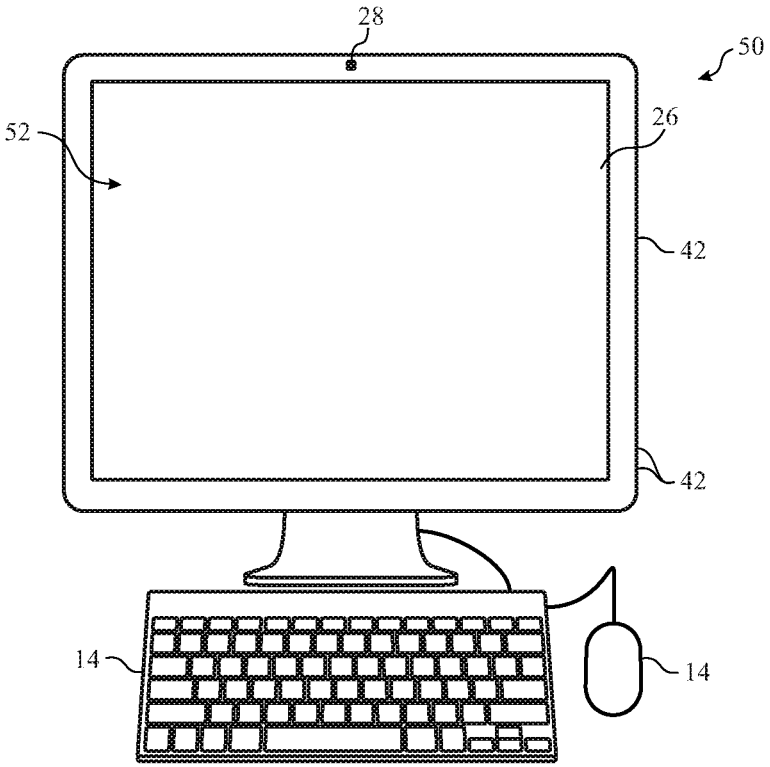
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
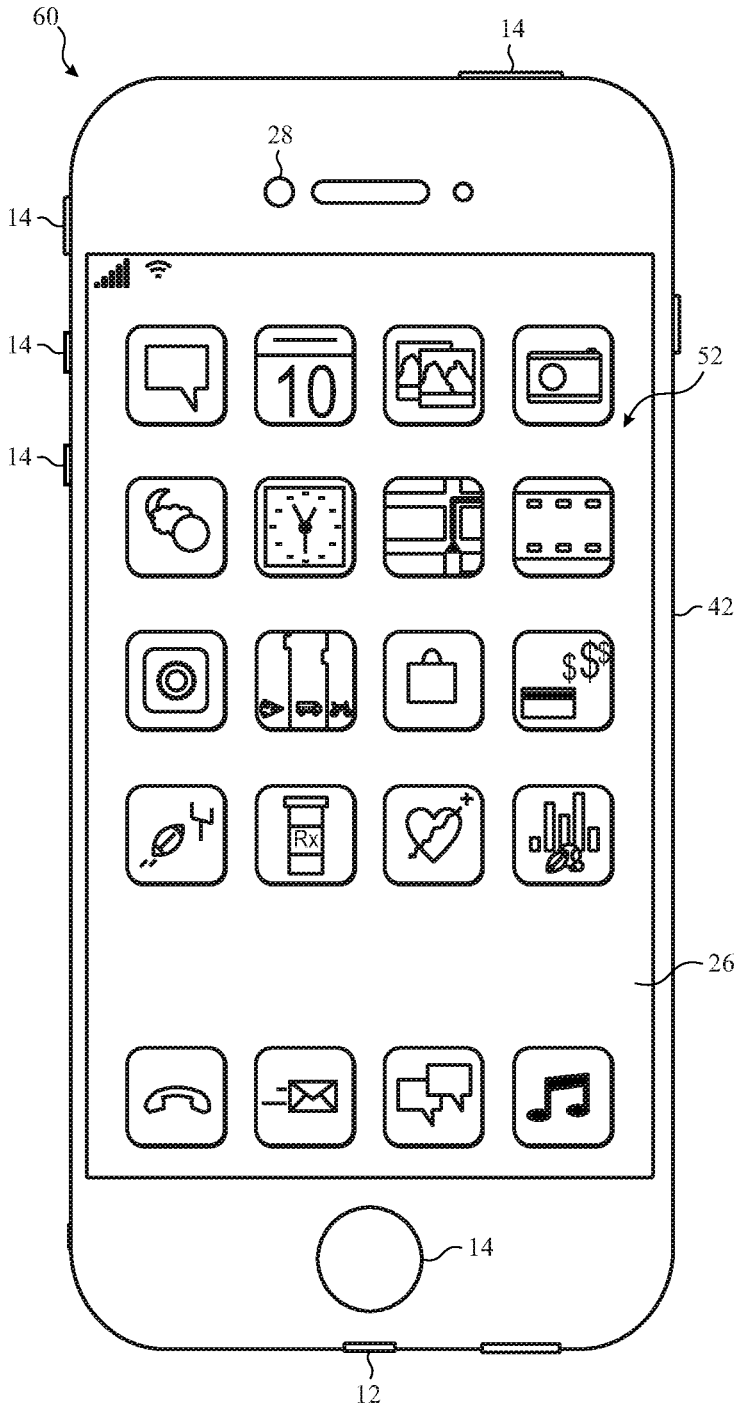
FIG. 4 is a front view of the electronic device of FIG. 1 in the form of a handheld portable electronic device, in accordance with embodiments described herein.
Figure 5:
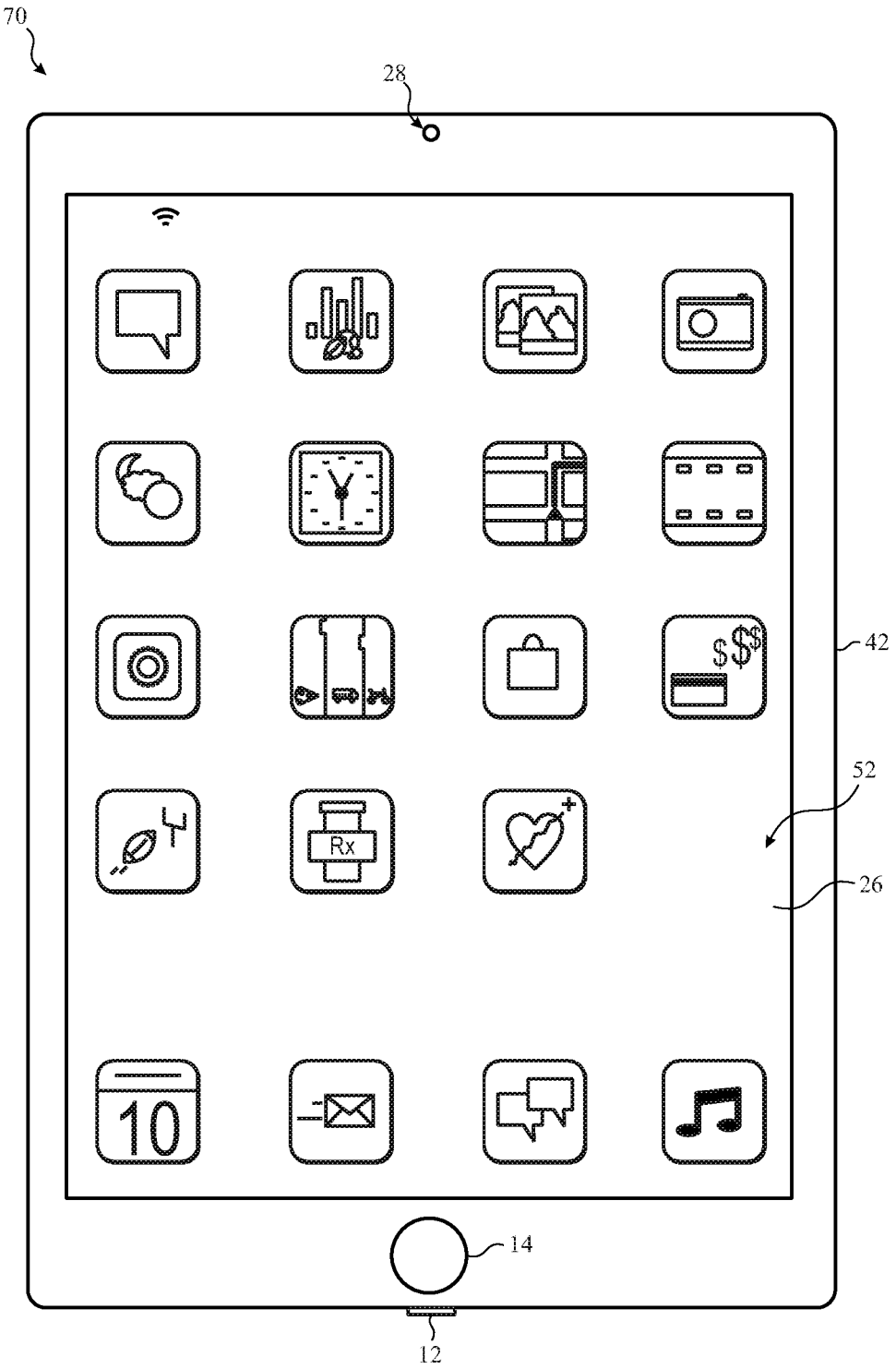
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
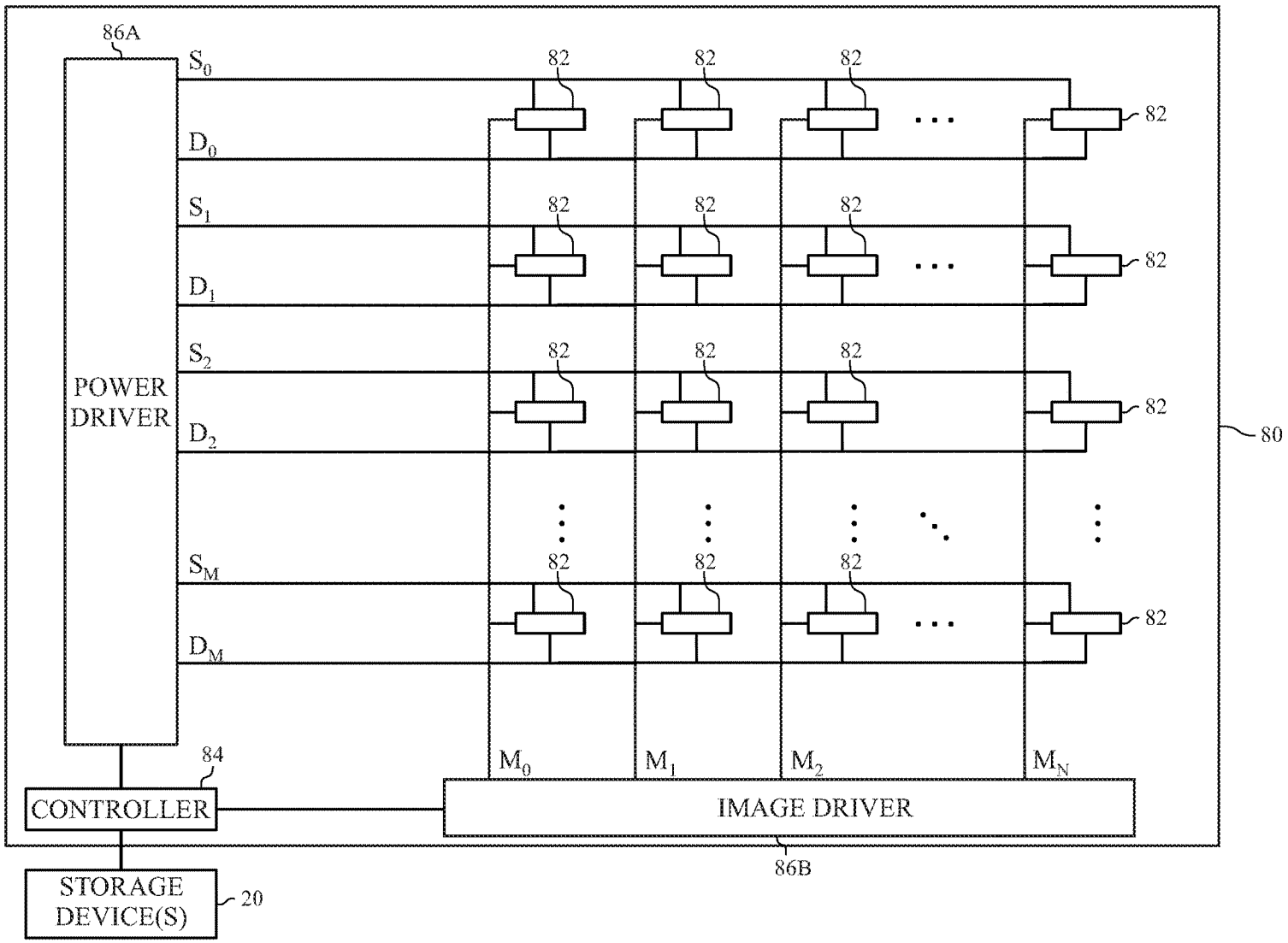
FIG. 6 is circuit diagram of the display of the electronic device of FIG. 1, in accordance with an embodiment.

Having provided some context with regard to possible forms that the electronic device 10 may take, the present discussion will now focus on the sensing system 30 of FIG. 1. As shown in FIG. 6, the display 26 may include a pixel array 80 having an array of one or more pixels 82. The display 26 may include any suitable circuitry to drive the pixels 82. In the example of FIG. 6, the display 26 includes a controller 84, a power driver 86A, an image driver 86B, and the array of the pixels 82. The power driver 86A and image driver 86B may drive individual luminance of the pixels 82. In some embodiments, the power driver 86A and the image driver 86B may include multiple channels for independent driving of the pixel 82. Each of the pixels 82 may include any suitable light emitting element, such as a LED, one example of which is an OLED. However, any other suitable type of pixel may also be used. Although the controller 84 is shown in the display 26, the controller 84 may be located outside of the display 26 in some embodiments. For example, the controller 84 may also be located in the processor 16.

The scan lines S0, S1, . . . , and Sm and driving lines D0, D1, . . . , and Dm may connect the power driver 86A to the pixel 82. The pixel 82 may receive on/off instructions through the scan lines S0, S1, . . . , and Sm and may generate programming voltages corresponding to data voltages transmitted from the driving lines D0, D1, . . . , and Dm. The programming voltages may be transmitted to each of the pixel 82 to emit light according to instructions from the image driver 86B through driving lines M0, M1, . . . , and Mn. Both the power driver 86A and the image driver 86B may be transmitted voltage signals at programmed voltages through respective driving lines to operate each pixel 82 at a state determined by the controller 84 to emit light. Each driver may supply voltage signals at a duty cycle and/or amplitude sufficient to operate each pixel 82.

The intensities of each of the pixels 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 26. In this manner, a first brightness of light (e.g., at a first luminosity and defined by a gray level) may emit from a pixel 82 in response to a first value of the image data and the pixel 82 may emit a second brightness of light (e.g., at a second luminosity) in response to a second value of the image data. Thus, image data may create a perceivable image output through indicating light intensities to apply to individual pixels 82.

The controller 84 may retrieve image data stored in the storage device(s) 20 indicative of light intensities for the colored light outputs for the pixels 82. In some embodiments, the processor 16 may provide image data directly to the controller 84. The image data may indicate the pixel light intensity and/or refresh rate data. For example, the controller 84 may receive an indication of the refresh rate of the display 26, a desired refresh rate of the display 26, frame and sub-frame period duration, or desired pixel luminance. The controller 84 may control the pixel 82 by using control signals to control elements of the pixel 82.

The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

In some embodiments, the pixel 82 may include a number of circuit components to enable the respective LED produce light for a prescribed amount of time or produce a particular gray level. By way of example, illustrates a pixel driving circuit 90 that may include a number of semiconductor devices that may coordinate the transmission of data signals to an organic light-emitting diode (LED) 92 of a respective pixel 82. In one embodiment, the pixel driving circuit 90 may receive input signals (e.g., emission signals, scan signals), which may be coordinated in a manner to cause the pixel driving circuit 90 to display image data and transmit a test data signal used to determine the OLED voltage ($V_{OLED}$) (e.g., voltage at Node 3) of the OLED 92.

Figure 7:
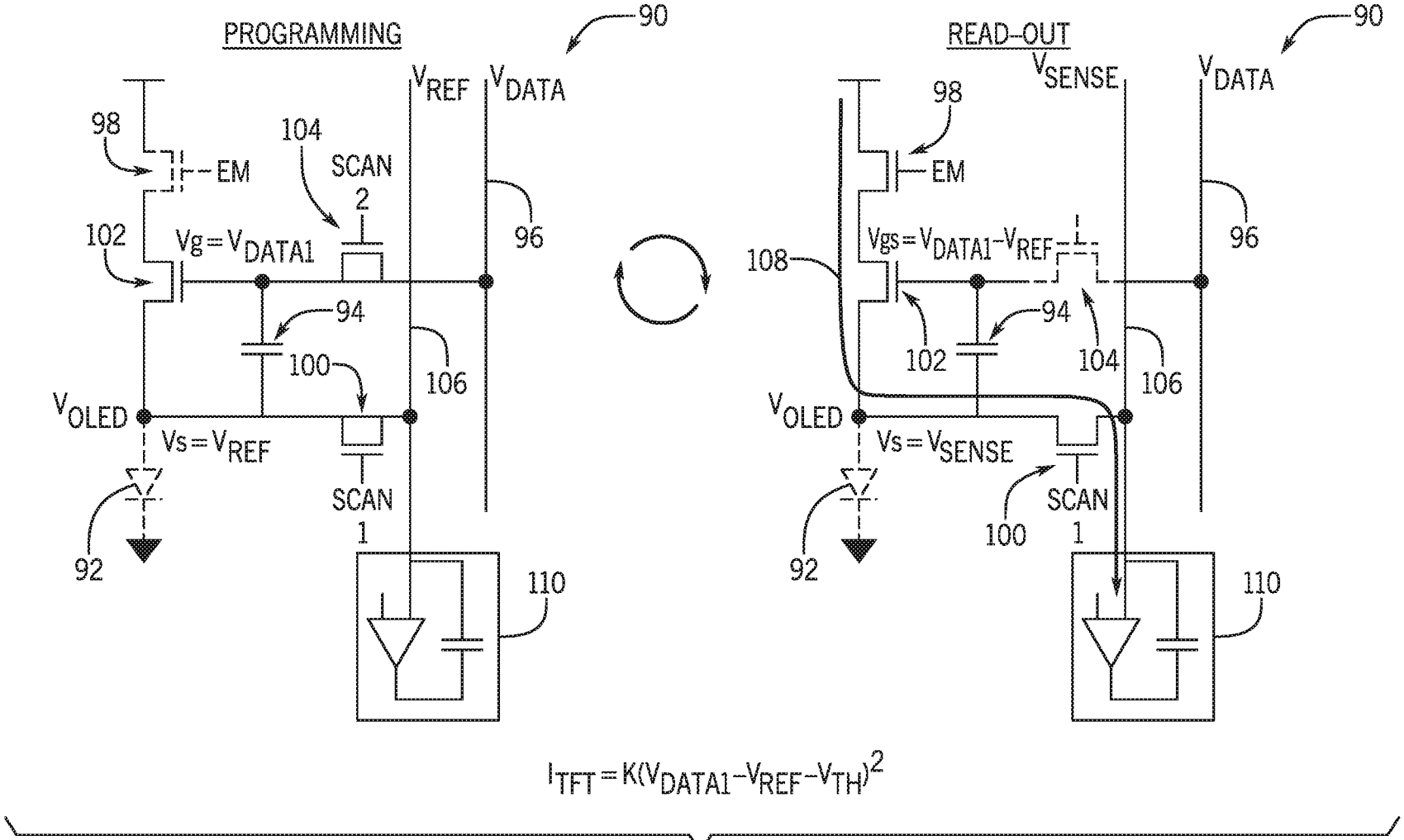
FIG. 7 is a circuit diagram of an example pixel driving circuit for measuring current through a thin-film-transistor associated with a pixel in the display of the electronic device of FIG. 1, in accordance with an embodiment.

With this in mind, the pixel driving circuit 90 may include, in one embodiment, N-type semiconductor devices, as shown in FIG. 7. Although the following description of the pixel driving circuit 90 is illustrated with the N-type semiconductor devices, it should be noted that the pixel driving circuit 90 may be designed using any suitable combination of N-type or P-type semiconductor devices.

In addition to the semiconductor devices, the pixel driving circuit 90 may include a capacitor 94 that may store data provided via data line 96. The close proximity between the various circuit components of the pixel driving circuit 90 and the various voltage sources (e.g., VDD, VSS) may also create parasitic capacitance within the pixel driving circuit 90. The capacitor 94 and the parasitic capacitance of the pixel driving circuit 90 may be combined in a capacitance ratio that represents the total capacitance of the pixel driving circuit 90.

In some embodiments, one or more of the semiconductors (e.g., TFTs) of the pixel driving circuit 90 may produce a current in response to the voltage received via the data line 96. When an emission signal (e.g., EM) is provided to a gate of the respective switch (e.g., switch 98), the OLED 92 may receive a current that corresponds to the data stored in the capacitor 94 when a switch 100 is open. As the OLED 92 illuminates in response to receiving the current ($I_{OLED}$), a voltage (e.g., $V_{OLED}$) may change when the OLED 92 receives the same amount of current over time. This change in voltage is representative of the aging effects of the OLED 92.

With the foregoing in mind, the sensing system 30 may coordinate the operation of the switches in the pixel driving circuit 90 to sense a current ($I_{TFT}$) conducted via a drive thin-film-transistor (TFT) (e.g., switch 102), which may be used to drive the OLED 92. By way of operation, a first data voltage ($V_{DATA1}$) may be received via the data line 96 during a programming stage of the pixel drive circuit 90 and a reference voltage ($V_{REF}$) may be received via a reference line 106. Switches 100 and 104 may be closed during the programming stage to charge the capacitor 94 to a voltage value that corresponds to a difference between the first data voltage ($V_{DATA1}$) and the reference voltage ($V_{REF}$). During a read-out phase of operation, the sensing system 30 may close the switches 98 and 100, while opening the switch 104. As a result, a drive TFT current ($I_{TFT}$) 108 may be conducted via the switches 98, 102, and 100 into a sensing circuit 110.

The sensing circuit 110 may include any suitable sensor that measures electrical characteristics (e.g., voltage, current) related to a connected node. In one embodiment, the sensing circuit 110 may include an active-front end (AFE) circuit that detects a voltage level or a current amount. The sensed drive TFT current ($I_{TFT}$) 108 may be stored in a suitable storage component or the like for further analysis.

As illustrated in FIG. 7, the OLED 92 remains off during the programming and read-out stages of operation. That is, since the switch 100 is closed during both the programming stage and the read-out stage, the drive TFT current ($I_{TFT}$) 108 does not conduct through the OLED 92. As such, the OLED 92 is not illuminated during these stages and thus do not cause the display 26 to depict any image data. In this way, the sensing system 30 may perform these operations during off time when the display 26 is not actively in use.

By employing the programming and read-out stages of operation as described above, the drive TFT current ($I_{TFT}$) 108 can be characterized based at least in part on certain electrical properties of the pixel drive circuit 90. For example, drive TFT current ($I_{TFT}$) 108 may be represented as shown below in Equation (1):

$$I_{TFT}=K(V_{DATA1}-V_{REF}-V_{TH})^2 \quad (1)$$

where K is a constant, $V_{DATA1}$ is the first data voltage provided via the data line 96, $V_{REF}$ is the reference voltage provided via the reference line 106, and $V_{TH}$ is a threshold voltage of the OLED 92.

Figure 8:
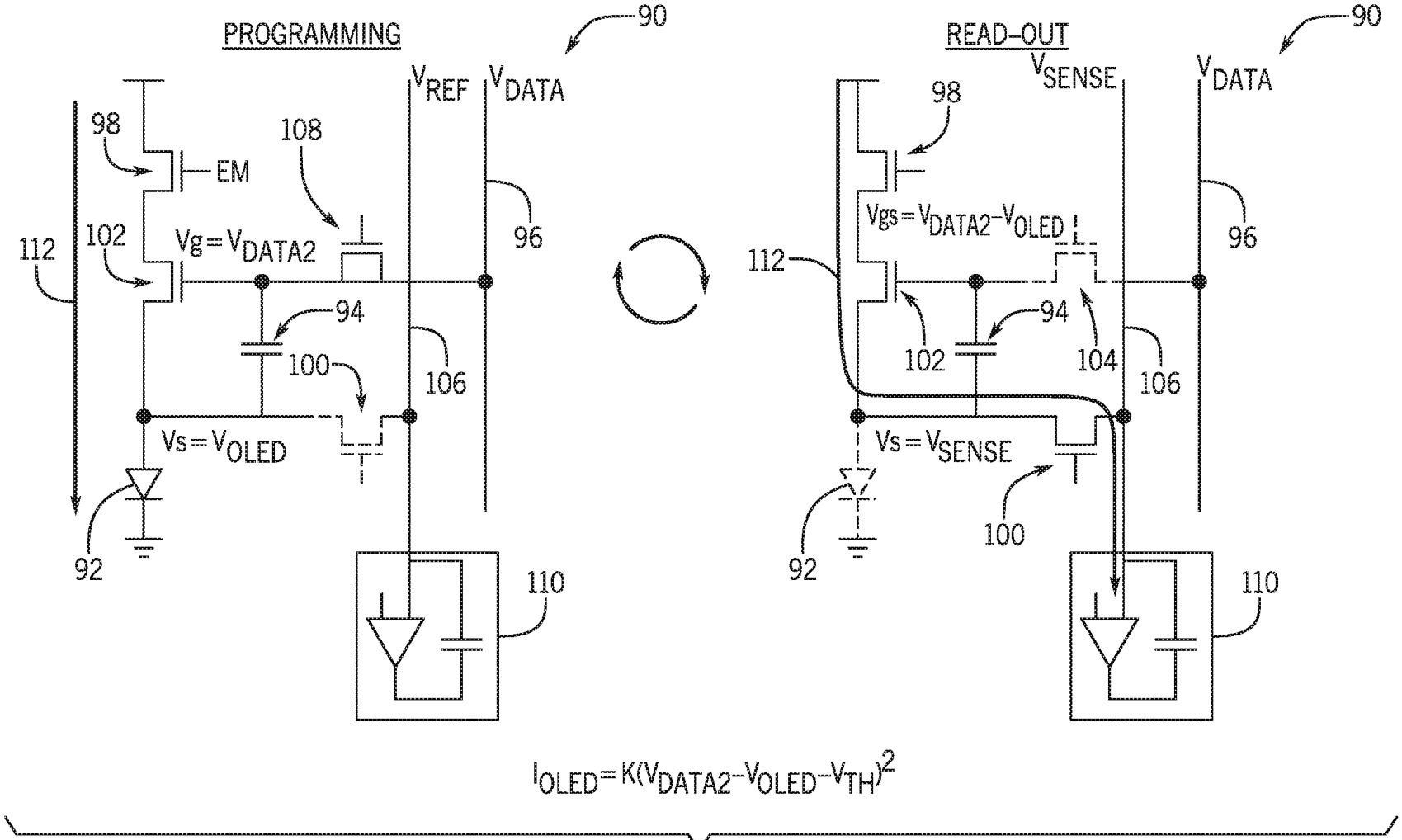
FIG. 8 is a circuit diagram of an example pixel driving circuit for measuring current through a light-emitting diode (LED) associated with a pixel in the display of the electronic device of FIG. 1, in accordance with an embodiment.

With the foregoing in mind, FIG. 8 illustrates a circuit diagram that depicts the sensing of an OLED current ($I_{OLED}$), which may be used to determine an OLED voltage ($V_{OLED}$) of the OLED 92 based at least in part on the drive TFT current ($I_{TFT}$) 108 described above. That is, the sensing system 30 may coordinate the operations of the switches in the pixel driving circuit 90 to cause the OLED current ($I_{OLED}$) or the current conducted in the OLED 92 while the OLED 92 is being programmed to be sent to the sensing circuit 110. In some embodiments, the sensing system 30 may sweep through data voltages until the OLED current ($I_{OLED}$) substantially matches the drive TFT current ($I_{TFT}$) 108 described above. Using the known data voltages provided to pixel driving circuit 90 to cause the OLED current ($I_{OLED}$) to substantially match the drive TFT current ($I_{TFT}$) 108, the sensing system 30 may determine the OLED voltage ($V_{OLED}$) that corresponds to the OLED 92 for a particular current, thereby sensing the OLED voltage ($V_{OLED}$).

Referring now to FIG. 8, the sensing system 30 may initially close switches 98 and 109 and open switch 100 during a programming stage of operation. In addition, the sensing system 30 may send a second data voltage (VDATA2) to the data line 96, thereby providing a gate signal to the switch 102. The resulting OLED current ($I_{OLED}$) 112 may initially be provided to the OLED 92 to program the OLED 92.

During a read-out stage of operation, the sensing system 30 may open the switch 109 and close the switch 100. As a result, the OLED current ($I_{OLED}$) 112 may be input into the sensing circuit 110, which may sense a value or amount of current provided via the OLED current ($I_{OLED}$) 112. The OLED current ($I_{OLED}$) 112 may be characterized according to Equation (2) shown below:

$$I_{OLED}=K(V_{DATA2}-V_{OLED}-V_{TH})^2 \quad (2)$$

where $V_{DATA2}$ corresponds to the second data voltage provided to the pixel driving circuit 90.

In certain embodiments, the sensing system 30 may adjust the second data voltage provided to the pixel driving circuit 90 until the OLED current ($I_{OLED}$) 112 substantially matches (e.g., within 1-10%) the drive TFT current ($I_{TFT}$) 108 stored in the storage component. By setting Equations (1) and (2) equal to each other, as shown in Equation (3), the sensing system 30 may solve for the OLED voltage ($V_{OLED}$), as shown in Equation (4).

$$K(V_{DATA1}-V_{REF}-V_{TH})^2=K(V_{DATA2}-V_{OLED}-V_{TH})^2 \quad (3)$$

$$V_{OLED}=V_{DATA1}-V_{DATA2}-V_{REF} \quad (4)$$

Figure 9:
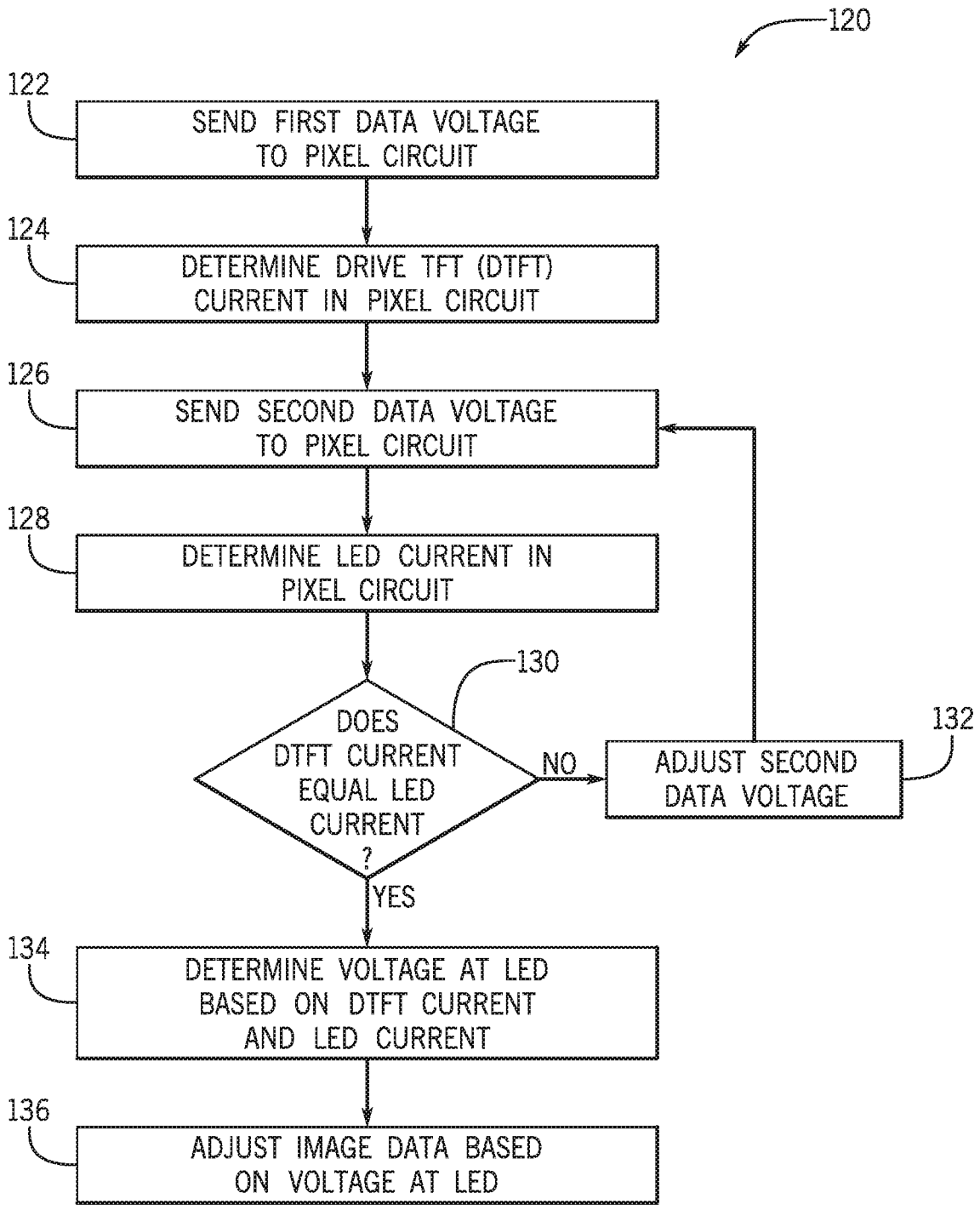
FIG. 9 is a flow chart of a method for compensating pixel data for display via the display of the electronic device of FIG. 1 based at least in part on a sensed voltage of a light-emitting diode (LED) in a pixel circuit, in accordance with an embodiment.

Keeping the foregoing in mind, FIG. 9 illustrates a flow chart of a method 120 for determining the OLED voltage ($V_{OLED}$) discussed above with reference to FIGS. 7 and 8. For the purposes of discussion, the following description of the method 120 will be described as being performed by the sensing system 30, but it should be noted that any suitable processing device may perform the method 120. Moreover, although the method 120 is described in a particular order, it should be understood that the method 120 may be performed in any suitable order.

Referring now to FIG. 9, at block 122, the sensing system 30 may send a first data voltage ($V_{DATA1}$) to a pixel driving circuit 90 of a particular pixel 82 in the display 26. The first data voltage ($V_{DATA1}$) may be a test value that is known to the sensing system 30, used for testing the aging parameter of the OLED 92 during manufacturing, or the like.

At block 124, the sensing system 30 may determine the drive TFT current 108 in the pixel circuit 90 based at least in part on the programming and read-out operations described above with reference to FIG. 8. That is, the sensing system 30 may coordinate the operations of the switches 98, 100, 102, and 104 to receive the first data voltage ($V_{DATA1}$) at the gate of the switch 102 and the capacitor 94. The sensing system 30 may then coordinate the operations of the switches 98, 100, 102, and 104 to direct the drive TFT current ($I_{TFT}$) to the sensing circuit 110 to measure the drive TFT current ($I_{TFT}$).

After sensing the drive TFT current ($I_{TFT}$), the sensing system 30 may, at block 126, send a second data voltage ($V_{DATA2}$) to the pixel driving circuit 90. The second data voltage ($V_{DATA2}$) may be different from the first data voltage ($V_{DATA1}$) or the same. In any case, the second data voltage ($V_{DATA2}$) is intended to cause the OLED 92 to receive a current ($I_{OLED}$) that substantially matches the drive TFT current ($I_{TFT}$) determined at block 124.

As such, at block 128, the sensing system 30 may determine the OLED current ($I_{OLED}$) based at least in part on the programming and read-out operations described above with reference to FIG. 8. That is, the sensing system 30 may coordinate the operations of the switches 98, 100, 102, and 104 to receive the second data voltage ($V_{DATA2}$) at the gate of the switch 102 and the capacitor 94. The sensing system 30 may then coordinate the operations of the switches 98, 100, 102, and 104 to direct the OLED current ($I_{OLED}$) to the sensing circuit 110 to measure the OLED current ($I_{OLED}$).

At block 130, the sensing system 30 may determine whether the sensed drive TFT current ($I_{TFT}$) substantially matches (e.g., within 1-10%) or equals the sensed OLED current ($I_{OLED}$). If the sensed drive TFT current ($I_{TFT}$) does not substantially match or equal the sensed OLED current ($I_{OLED}$), the sensing system 30 may proceed to block 132 and adjust the second data voltage ($V_{DATA2}$). The sensing system 30 may then return to block 126 and send the adjusted second data voltage ($V_{DATA2}$) to the pixel drive circuit 90.

If, however, the sensed drive TFT current ($I_{TFT}$) does substantially match or equal the sensed OLED current ($I_{OLED}$), the sensing system 30 may proceed to block 134 and determine the OLED voltage ($V_{OLED}$) based at least in part on Equations (3) and (4) provided above. At block 136, the sensing system 30 may use the OLED voltage ($V_{OLED}$) to determine an adjustment to pixel data or image data received by the display driver 29. That is, as discussed above, the OLED voltage ($V_{OLED}$) may represent a degradation or aging of the OLED 92 over time. As the OLED 92 ages, the threshold voltage ($V_{TH}$) that corresponds to operating the OLED 92 may shift. To compensate for this shift, the sensing system 30 may determine a difference between an expected voltage at the anode of the OLED 92 for a target current (e.g., $I_{TFT}$) and the sensed voltage (e.g., $V_{OLED}$) at the anode of the OLED 92 when the OLED 92 receives the target current. Based at least in part on this difference, the sensing system 30, the display driver 29, or other suitable component may determine a compensation value (e.g., $\Delta V$) to apply to the pixel data received by the display driver 29. As a result, the display 26 may present image data that more accurately represents the desired color and luminance values of the input image data.

By employing the systems and methods described herein, the sensing system 30 may detect for aging effects to OLEDs without illuminating the OLEDs as compared to other sensing schemes. Since each individual OLED and display device may be manufactured using different processes, be composed of different types of material, operated in different manners, be stored in different ambient conditions, and the like, each OLED ages in a different manner. As such, the presently disclosed embodiments may enable the sensing of the OLED voltage to assist the display driver 29 in depicting image data via the display 26 while compensating for the effects of the OLED aging.

Although the foregoing description of the embodiments for improving the uniformity of the display 26 is described with respect to OLED aging, it should be noted that the embodiments presented herein are not limited to being applied to OLEDs. Instead, the presently disclosed embodiments may be applied to any suitable light emitting diode used in an electronic display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A display device, comprising:

a plurality of pixels configured to display image data on a display; and a circuit configured to:

measure a first current associated with a light-emitting diode (LED) of a pixel of the plurality of pixels in response to the circuit receiving a first data voltage via a data line configured to provide a plurality of data voltages that corresponds to the image data to one or more gates of one or more switches;

measure a second current associated with the LED of the pixel of the plurality of pixels in response to the circuit receiving a second data voltage via the data line; and determine a voltage at a node of the LED based at least in part on the first current and the second current, wherein the voltage is determined based on the first data voltage, the second data voltage, a reference voltage provided to the circuit via a reference line coupled to the node of the LED and different from the data line, and a threshold voltage of the LED for the voltage when a first current amount associated with the first current substantially matches a second current amount associated with the second current, wherein the threshold voltage corresponds to an operation of the LED.

2. The display device of claim 1, wherein the circuit is configured to determine the voltage at the node of the LED by:

continuously adjusting the second data voltage until the first current substantially matches the second current; and determining the voltage at the node of the LED based at least in part on the first current substantially matching the second current.

3. The display device of claim 1, wherein the circuit is configured to measure the first current associated with the LED at least in part by:

programming the LED based at least in part on the first data voltage; and directing the first current to a sensing circuit configured to detect the first current amount associated with the first current.

4. The display device of claim 3, wherein the circuit is configured to measure the second current associated with the LED at least in part by:

programming the LED based at least in part on the second data voltage; and directing the second current to the sensing circuit configured to detect the second current amount associated with the second current.

5. The display device of claim 1, wherein the first current corresponds to a current conducted via a drive thin-film-transistor of the circuit.

6. The display device of claim 1, wherein the second current corresponds to a current conducted via the LED.

7. The display device of claim 1, wherein the first current and the second current are measured while the LED is not illuminated.

8. A method, comprising:

receiving a first current associated with a light-emitting diode (LED) of a pixel of a plurality of pixels in response to circuitry receiving a first data voltage via a data line configured to provide a plurality of data voltages that corresponds to image data to one or more gates of one or more switches;

receiving a second current associated with the LED of the pixel of the plurality of pixels in response to the circuitry receiving a second data voltage via the data line;

adjusting the second data voltage until the first current is substantially equal to the second current; and determining a voltage at a node of the LED based at least in part on the first current and the second current after the second data voltage has been adjusted until the first current is substantially equal to the second current, wherein the voltage is determined based on the first data voltage, the second data voltage, a reference voltage provided to the circuitry via a reference line coupled to the node of the LED and different from the data line, and a threshold voltage of the LED corresponding to an operation of the LED.

9. The method of claim 8, wherein receiving the first current comprises:

closing, via the circuitry, a first switch coupled to the data line configured to provide the first data voltage to a gate of a drive thin-film-transistor (TFT) switch; and opening, via the circuitry, the first switch, thereby causing the first current to be input into a sensing circuit configured to measure an amount of current of the first current.

10. The method of claim 9, wherein the first current corresponds to a current conducted via the drive TFT switch.

11. The method of claim 9, wherein receiving the second current comprises:

closing, via the circuitry, the first switch in response to the data line receiving the second data voltage;

opening, via the circuitry, a second switch in response to the data line receiving the second data voltage; and opening, via the circuitry, the first switch and closing the second switch after a capacitor coupled between the first switch and the second switch is charged to a threshold, thereby causing the second current to be input into the sensing circuit configured to measure an additional amount of current of the second current.

12. The method of claim 11, wherein the second current corresponds to a current conducted via the LED.

13. The method of claim 8, wherein the LED comprises an organic light-emitting diode.

14. The method of claim 13, wherein the voltage at the node of the LED is determined according to:

$$V_{OLED}=V_{DATA1}-V_{DATA2}-V_{REF}$$

wherein $V_{OLED}$ corresponds to the voltage, $V_{DATA1}$ corresponds to the first data voltage, $V_{DATA2}$ corresponds to the second data voltage, and $V_{REF}$ corresponds to the reference voltage provided to the circuitry.

15. The method of claim 8, wherein determining the voltage at the node of the LED is based at least in part on the first data voltage and the second data voltage.

16. A non-transitory computer-readable medium comprising computer-executable instructions that, when executed, cause a processor to:

receive a first current associated with a light-emitting diode (LED) of a pixel of a plurality of pixels in response to the pixel receiving a first data voltage via a data line configured to provide a plurality of data voltages that corresponds to image data to one or more gates of one or more switches;

receive a second current associated with the LED of the pixel of the plurality of pixels in response to the pixel receiving a second data voltage via the data line;

adjust the second data voltage until the first current is substantially equal to the second current; and determine a voltage at a node of the LED based at least in part on the first current and the second current after the second data voltage has been adjusted until the first current is substantially equal to the second current, wherein the voltage is determined based on a reference voltage provided to the pixel via a reference line coupled to the node of the LED and different from the data line and a threshold voltage of the LED corresponding to an operation of the LED.

17. The non-transitory computer-readable medium of claim 16, wherein the voltage at the node of the LED corresponds to an age of the LED.

18. The non-transitory computer-readable medium of claim 16, wherein the first data voltage and the second data voltage correspond to a first grey level and a second grey level, respectively.

19. The non-transitory computer-readable medium of claim 16, wherein the computer-executable instructions cause the processor to adjust pixel data provided to a display device based at least in part on the voltage.

20. The non-transitory computer-readable medium of claim 16, wherein the LED comprises an organic light-emitting diode.

* * * * *